US007703853B2

(12) United States Patent
Hung

(10) Patent No.: US 7,703,853 B2
(45) Date of Patent: Apr. 27, 2010

(54) CHAIR WITH HEIGHT ADJUSTABLE ARMRESTS AND A FOLDABLE BACK

(76) Inventor: Yu-Ching Hung, 11F.-4,No. 130, Jingcheng Rd., Taichung 40352 (TW)

( * ) Notice: Subject to any disclaimer, the term of this patent is extended or adjusted under 35 U.S.C. 154(b) by 0 days.

(21) Appl. No.: 12/207,469

(22) Filed: Sep. 9, 2008

(65) Prior Publication Data

US 2010/0060065 A1 Mar. 11, 2010

(51) Int. Cl.
*A47C 7/54* (2006.01)

(52) U.S. Cl. ..... 297/378.12; 297/125; 297/411.36

(58) Field of Classification Search ..... 297/125, 297/127, 378.12, 411.36
See application file for complete search history.

(56) References Cited

U.S. PATENT DOCUMENTS 371,099 A * 10/1887 Schleier ..... 297/127
2,650,657 A * 9/1953 Ohlsson ..... 297/440.23
4,919,485 A * 4/1990 Guichon ..... 297/440.23
5,335,971 A * 8/1994 Kelley ..... 297/378.12
5,382,079 A * 1/1995 Wilson et al. ..... 297/411.36
5,785,383 A * 7/1998 Otero ..... 297/255
6,422,654 B1 * 7/2002 Grove ..... 297/440.16
6,786,553 B1 * 9/2004 Grove ..... 297/378.12
7,303,230 B2 * 12/2007 Munn et al. ..... 297/255
7,360,839 B1 * 4/2008 Chen ..... 297/411.2

* cited by examiner

*Primary Examiner*—Peter R. Brown
(74) *Attorney, Agent, or Firm*—Banger Shia

(57) ABSTRACT

A chair with height adjustable armrests and a foldable back utilizes an engaging rod to control the height at which the armrest is positioned and a locking assembly to control the folding operation of the chair back, so that the user can adjust the height of the armrests as desired and fold the chair back for facilitating storage of the chair.

3 Claims, 13 Drawing Sheets

CHAIR WITH HEIGHT ADJUSTABLE ARMRESTS AND A FOLDABLE BACK

BACKGROUND OF THE INVENTION

1. Field of the Invention

The present invention relates to chair parts, and more particularly to a chair with height adjustable armrests and a foldable back.

2. Description of the Prior Art

Conventional chairs are inconvenient to store since the chair back occupies large space. As a result of this, a chair with a foldable back was developed on the market, such as U.S. Pat. No. 7,311,361 entitled with "apparatus for simultaneously folding seat chair back and armrest, although such a chair is quite convenient to store since the chair back and the armrests can be simultaneously folded, its structure is relatively complex, and the height of the armrest cannot be adjusted as desired.

Hence, Taiwan Patent No. 086217219, entitled with "height adjusting apparatus for chair armrest" was developed in order to overcome the above problem. This technology utilizes both ends of a spring to push the cylindrical engaging portions outwards and utilizes the engaging portions to position the chair armrest, so that if the height of the chair needs adjusting, the spring will be axially compressed in such a manner that the engaging portions axially retract to disengage from the chair armrests. Obviously, the technology that a spring cooperates with a cylindrical structure to move axially is not new, but the technology of controlling the armrest position is not limited to enabling the engaging portions to move axially to position the armrests, so that the applicant of the present invention has developed a chair with height adjustable armrests and a foldable back from the angle of changing the controlling and positioning manner and simplifying the structure used for folding the chair back.

SUMMARY OF THE INVENTION

The primary objective of the present invention is to provide a chair with height adjustable armrests and a foldable back, which controls the positioning of the armrests to adjust the height of the armrests by operating a pivoting rotation of two engaging rods and utilizes a locking assembly to position the chair back, so as to enable the chair back to be pivotally folded when the chair back is released.

In order to achieve the above objectives, the chair comprises a chair seat assembly, a chair back and two armrests. Both sides of the chair seat assembly are pivoted to both sides of the chair back. The chair seat assembly is provided with an elastically-restorable locking assembly including an engaging protrusion. The chair back is formed with an engaging groove for cooperating with the engaging protrusion of the locking assembly of the chair seat assembly. The engaging protrusion is inserted into the engaging groove to position the chair back. The chair seat assembly includes an inserting groove at each of two opposite sides thereof. Each of the inserting grooves includes plural protruding blocks from an opening to a bottom thereof. Beneath the respective protruding blocks is defined an inserting space. The respective armrests include an inserting planar member and an elastically-restorable engaging rod. The inserting planar members of the two armrests are respectively inserted in the two inserting grooves of the chair seat assembly. Each of the engaging rods includes at one end thereof an inserting block to be inserted into one of inserting spaces in the respective inserting grooves to position the armrest.

If the locking assembly is operated to make the engaging protrusion disengage from the engaging groove, the chair back can be pivotally folded. If the engaging rods of the armrests are operated to pivot, the inserting block of the respective engaging rods can disengage from the inserting space to adjust the height of the armrests. The chair and the armrests can be repositioned due to the elastically-restorable function of the locking assembly and the engaging rods.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
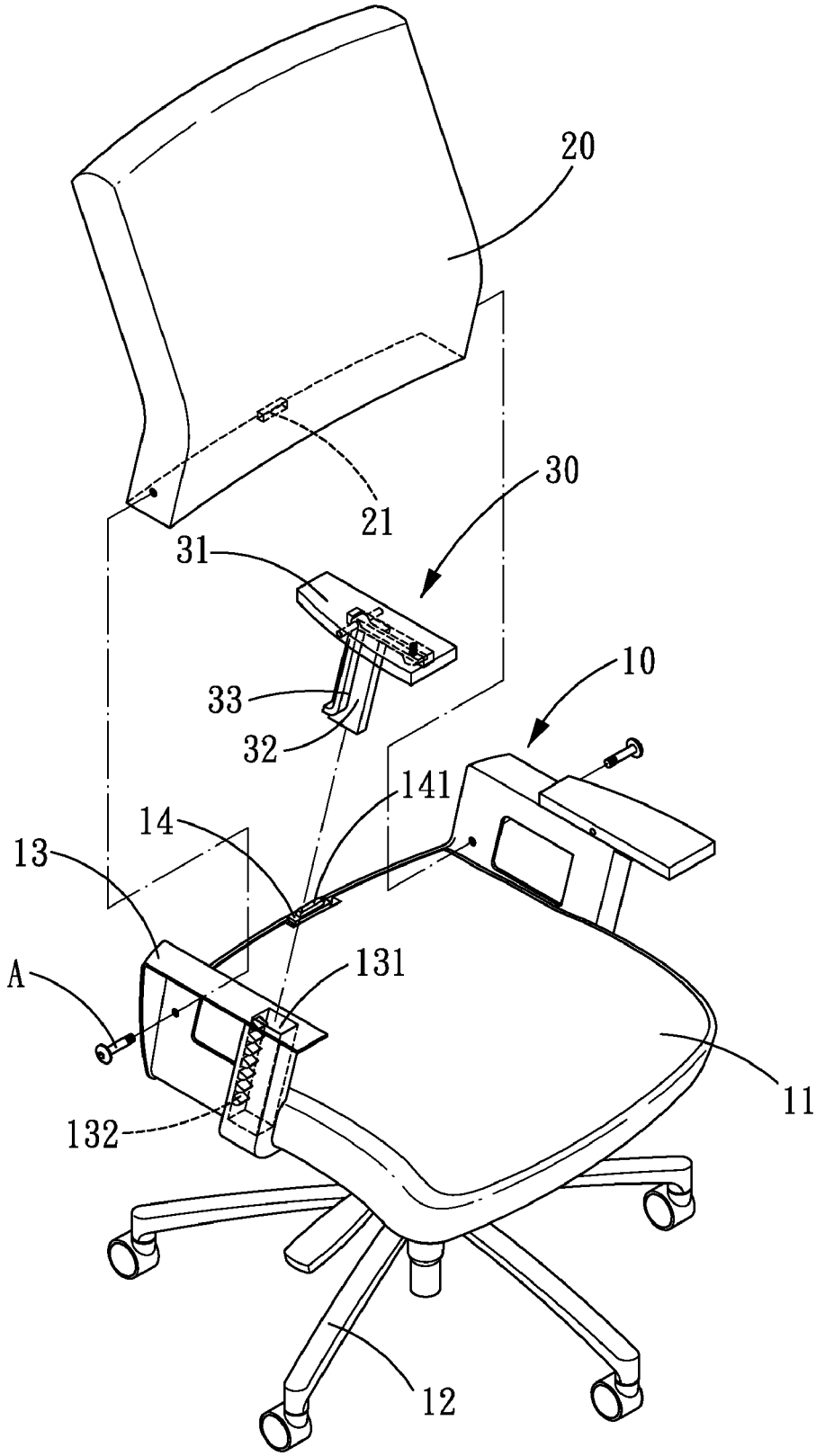
FIG. 1 is an exploded view of a chair with height adjustable armrests and a foldable back in accordance with the present invention.
Figure 2:
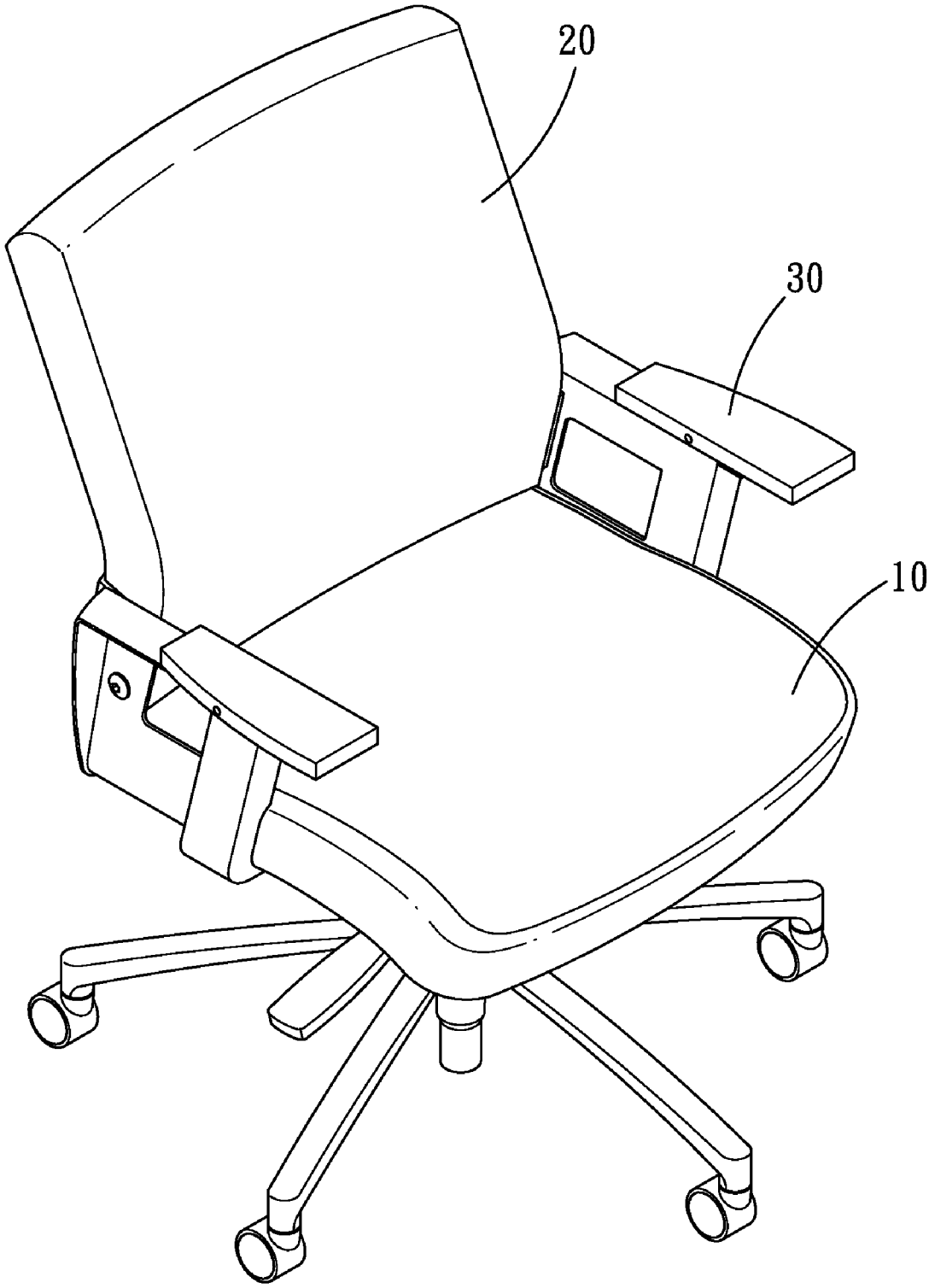
FIG. 2 is a perspective view of the chair with height adjustable armrests and a foldable back in accordance with the present invention.
Figure 3:
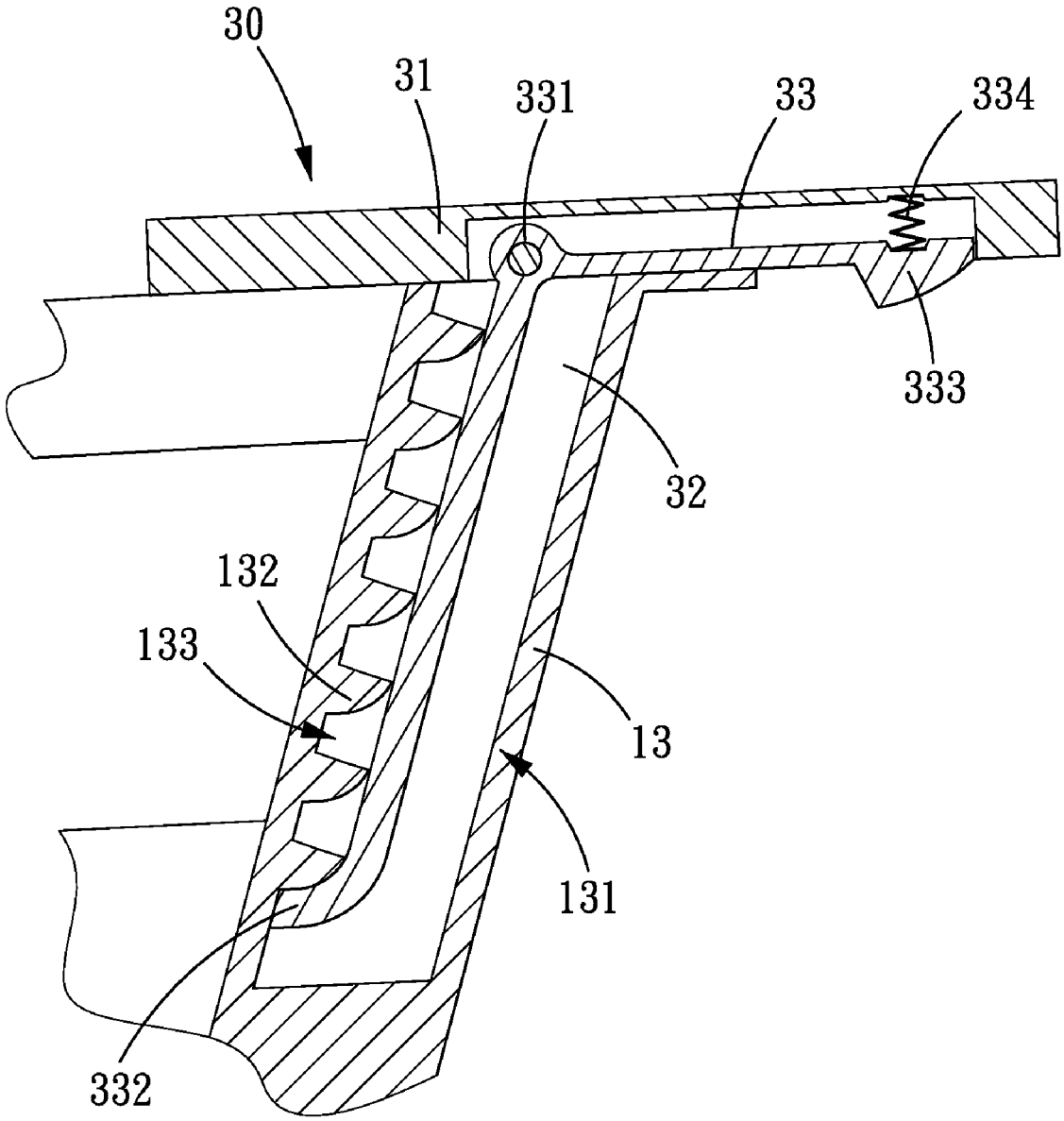
FIG. 3 is a cross-sectional view showing that an armrest is positioned in the inserting groove of the chair seat assembly in accordance with the present invention.

Referring to FIGS. 1-3, a chair with height adjustable armrests and a foldable back in accordance with a preferred embodiment of the present invention comprises a chair seat assembly 10, a chair back 20, and two armrests 30.

The chair seat assembly 10 includes a seat 11, a leg assembly 12, two loading members 13 and a locking assembly 14. The leg assembly 12 is disposed at the bottom of the seat 11, and the two loading members 13 are disposed at both sides of the seat 11. The respective loading members 13 include an inserting groove 131 on an inner surface of which is formed plural spaced-apart protruding blocks 132. Beneath the respective protruding blocks 132 is defined an inserting space 133. The locking assembly 14 is an elastically-restorable assembly disposed at the rear end of the seat 11 and includes an engaging protrusion 141.

Both sides of the chair back 20 are pivoted to the two loading members 13 of the chair seat assembly 10 through pivot pins A. The chair back 20 is formed with an engaging groove 121 in the bottom thereof for cooperating with the engaging protrusion 141 of the locking assembly 14 of the chair seat assembly 10. The engaging groove 21 is provided for insertion of the engaging protrusion 141 to lock the chair back 20 to the seat in an operative position.

Figure 14:
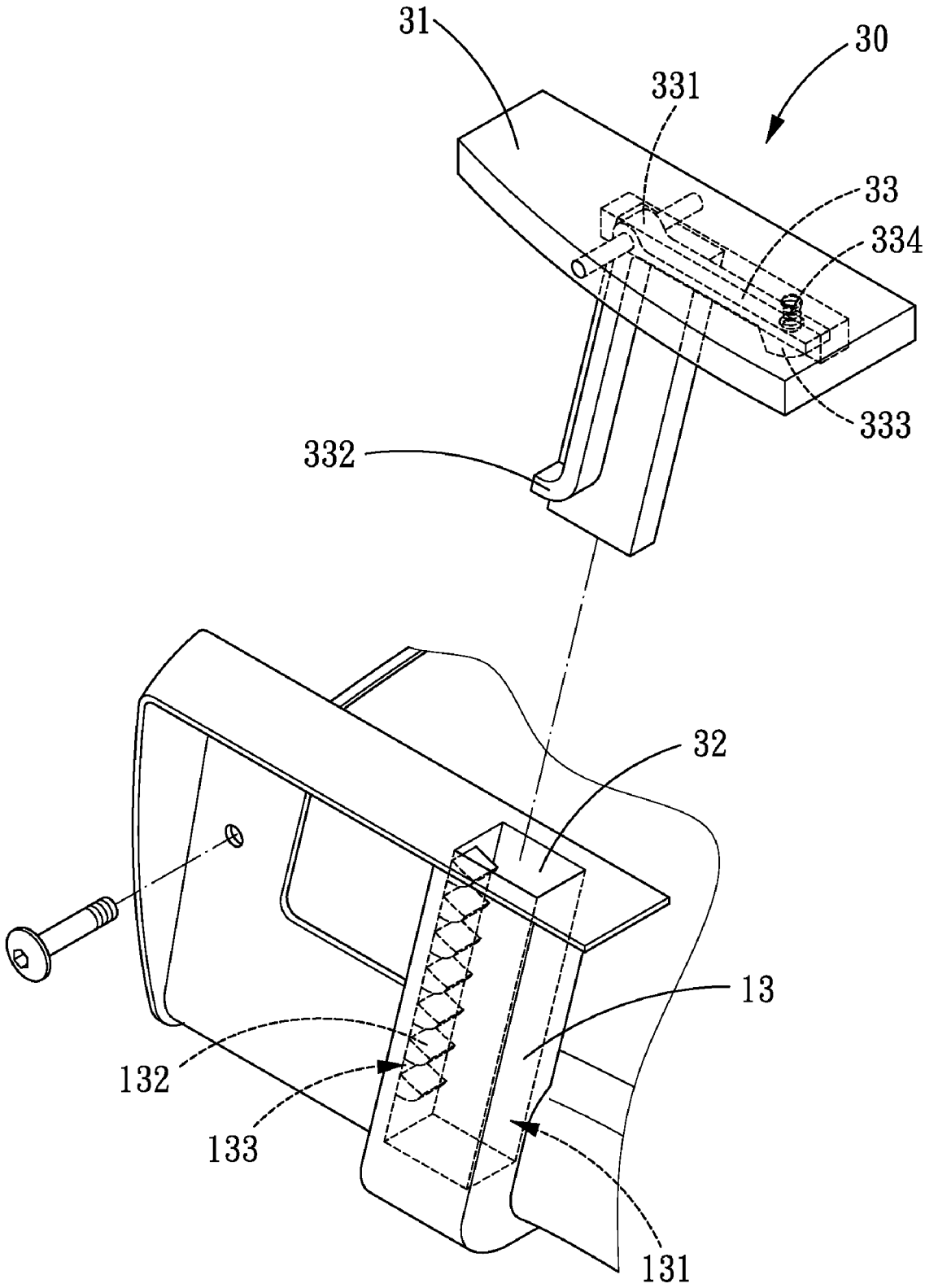
FIG. 14 is an enlarged view of a part of FIG. 1 for showing the connection of the inserting planar member, the support board and the engaging rod.

The two armrests 30 each include a support board 31, an inserting planar member 32 and an engaging rod 33. As shown in FIGS. 3 and 14, one side of the support board 31 is connected with the inserting planar member 32, and the inserting planar member 32 of the armrest 30 is inserted into the inserting groove 131 of the loading member 13. Each of the engaging rods 33 is L-shaped and provided with a pivoting portion 331 between both ends thereof for enabling the engaging rods 33 to be pivoted to the respective support boards 31. Each of the engaging rods 33 is L-shaped and has one end formed with an inserting block 332 and the other end formed with a pressing block 333. The one end of the L-shaped engaging rod 33 with the inserting block 332 has a lateral side abutted against the inserting planar member 32. The support board 31 is provided with a longitudinal groove for accommodation of the other end of the L-shaped engaging rod 33 with the pressing block 333, and is further defined with a transverse hole for insertion of a pin, the transverse hole is in communication with the longitudinal groove. The pivoting portion 331 takes the form of a pivot hole defined at the corner of the L-shaped engaging rod 33, so that each of the L-shaped engaging rods 33 is pivoted to the respective support boards 31 by insertion of the pin into the pivot hole of the pivoting portion 331. The respective pressing blocks 333 are provided with a spring 334, and the springs 334 abut against the respective support boards 31 to make the respective engaging rods 33 pivot, so as to insert the inserting block 332 of the engaging rod 33 into one of the inserting spaces 133 of the inserting groove 131, thus positioning the armrest 30 in the inserting groove 131.

Figure 4:
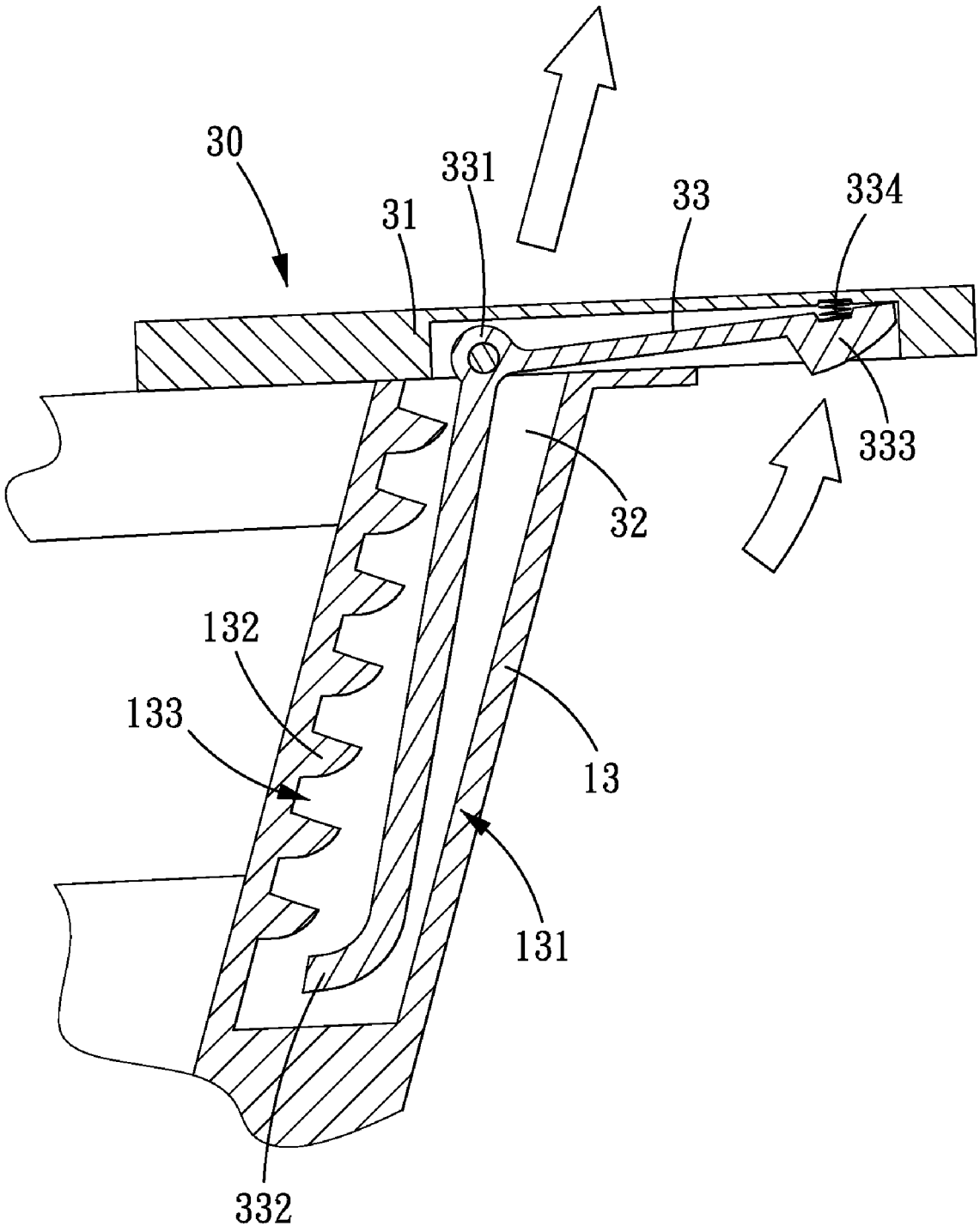
FIG. 4 is a cross-sectional view showing that an inserting block disengages from the inserting space of an inserting groove in accordance with the present invention.
Figure 5:
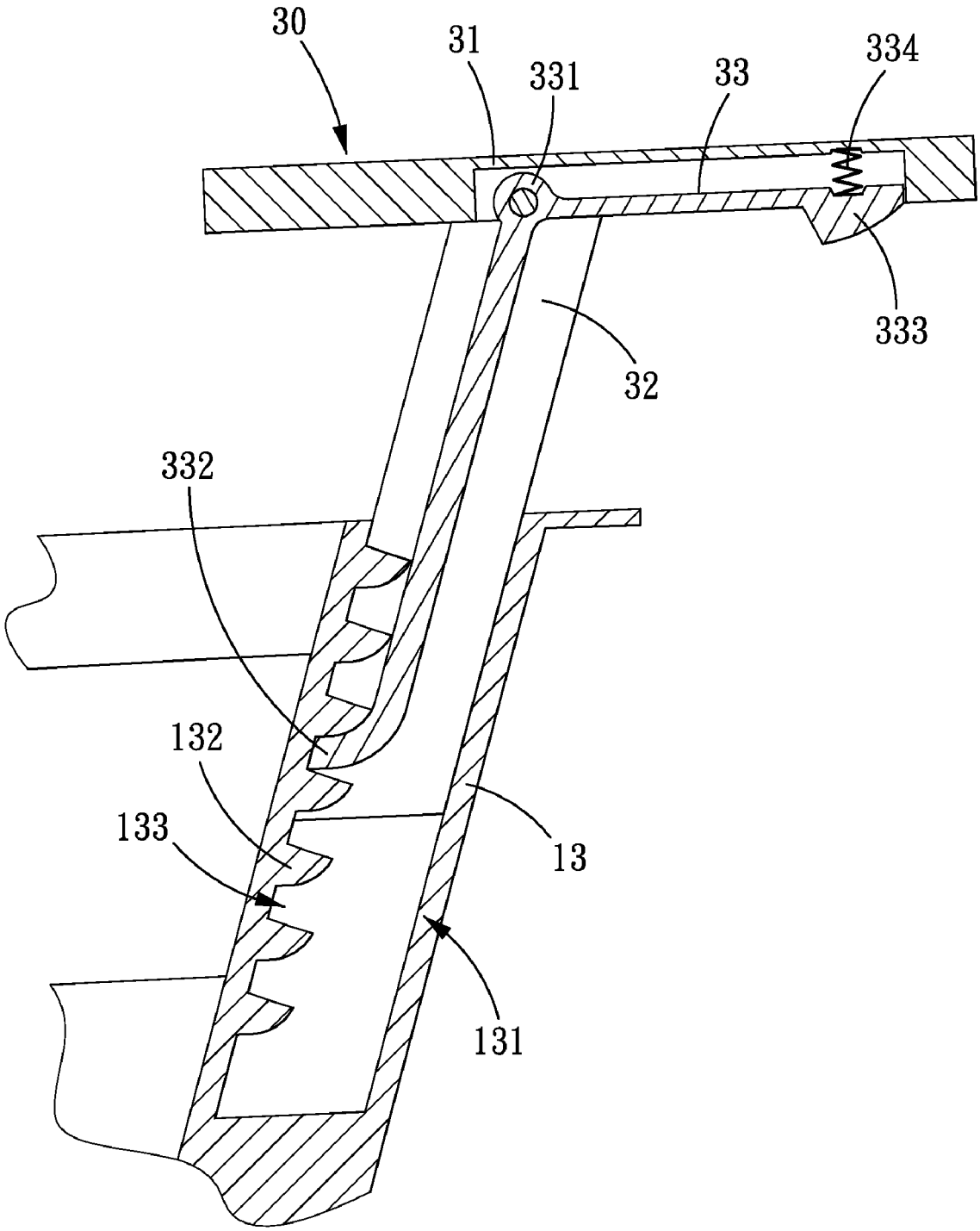
FIG. 5 is a cross-sectional view showing how the height of the armrest is adjusted in accordance with the present invention.

When the height of the respective armrests 30 is to be adjusted, as shown in FIG. 4, the user can press the pressing block 333, so that the pressing block 333 will be forced to compress the spring 334 to make the engaging rod 33 pivot. Meanwhile, the inserting block 332 of the engaging rod 33 will disengage from the inserting space 133 of the inserting groove 131 of the loading member 13 of the chair seat assembly 10, so that the inserting planar member 32 can move along the inserting groove 131 of the loading member 13 of the chair seat assembly 10. As shown in FIG. 5, after the pressing block 333 is not pressed any longer, the spring will push the engaging rod 33 to pivot by its restoring force, so as to insert the inserting block 332 of the engaging rod 33 into another inserting space 133 of the inserting groove 131, thus positioning the armrest 30 in the inserting groove 131 again. As a result, the height of the armrest 30 is adjusted.

Figure 6:
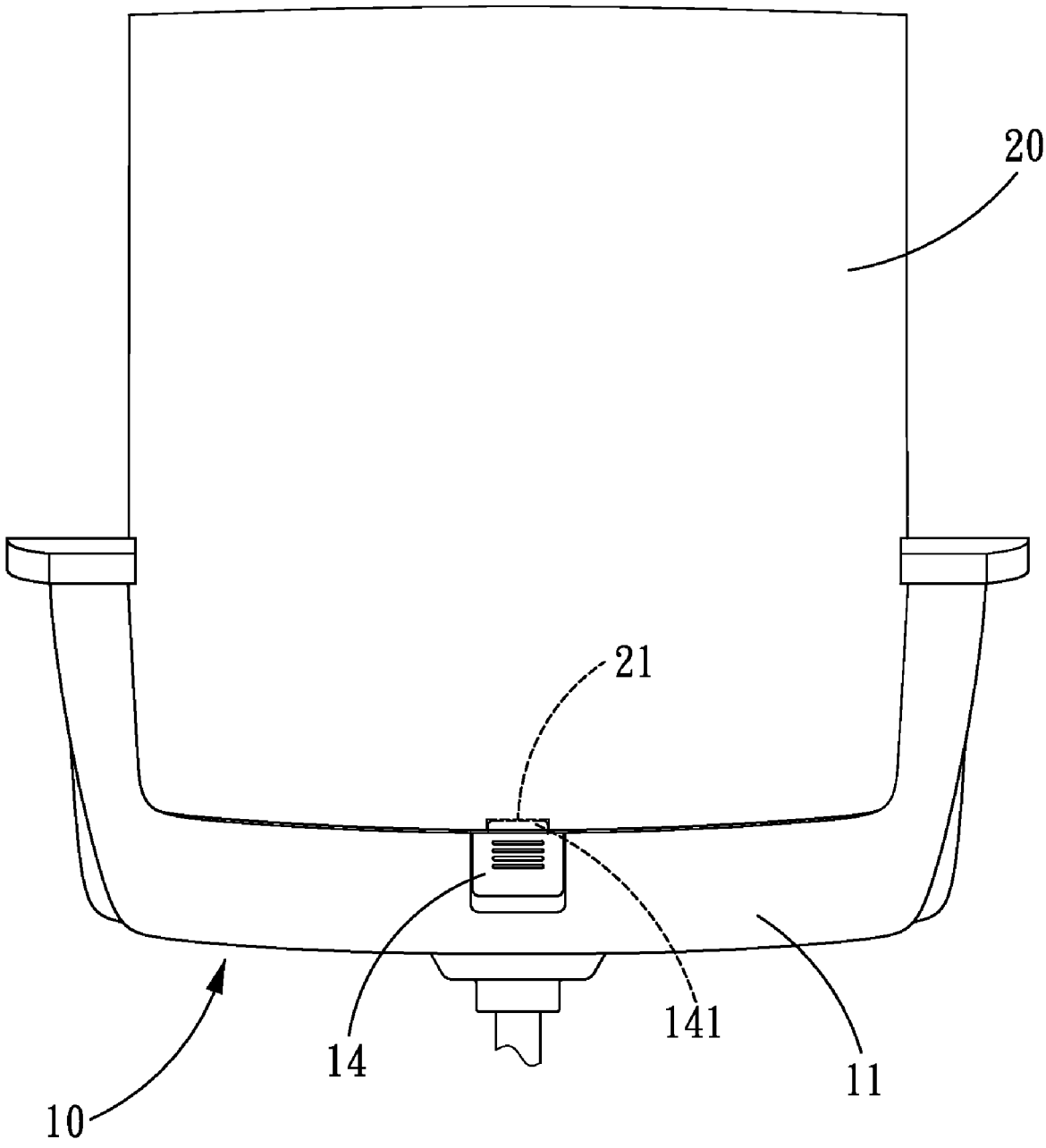
FIG. 6 is a schematic view showing that an engaging protrusion of a locking assembly is inserted in an engaging groove of the chair back in accordance with the present invention.
Figure 7:
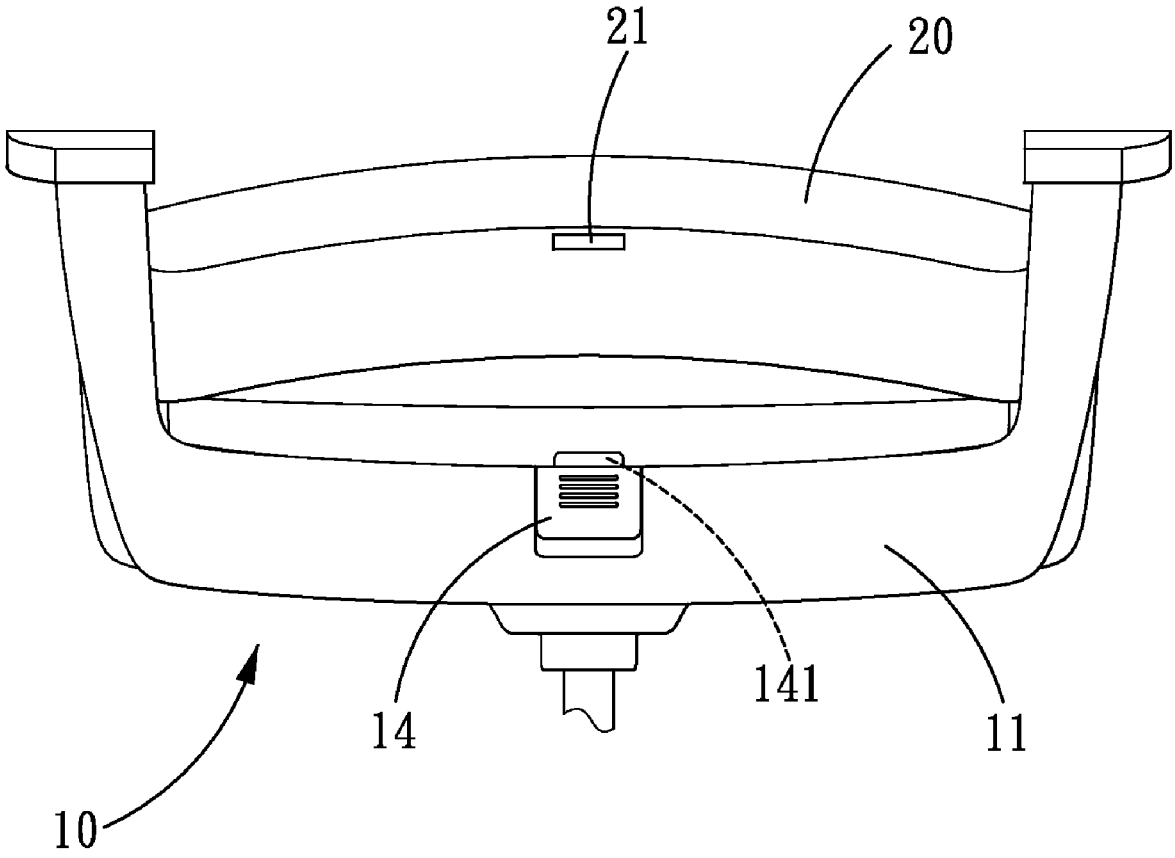
FIG. 7 is a schematic view showing that the engaging protrusion of a locking assembly is moved out of the engaging groove of the chair back in accordance with the present invention.
Figure 8:
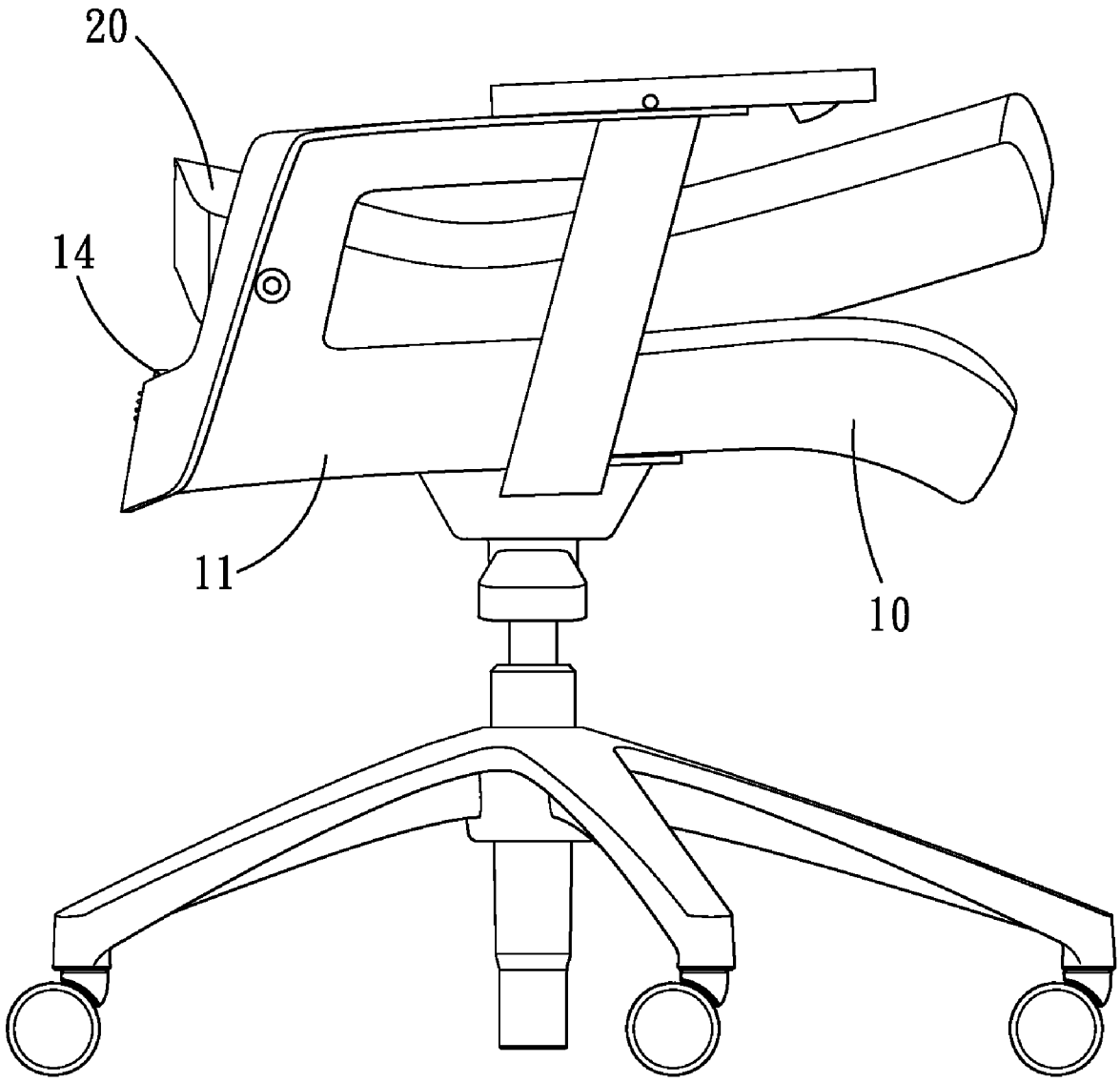
FIG. 8 is a schematic view showing the chair back in accordance with the present invention is folded.
Figure 9:
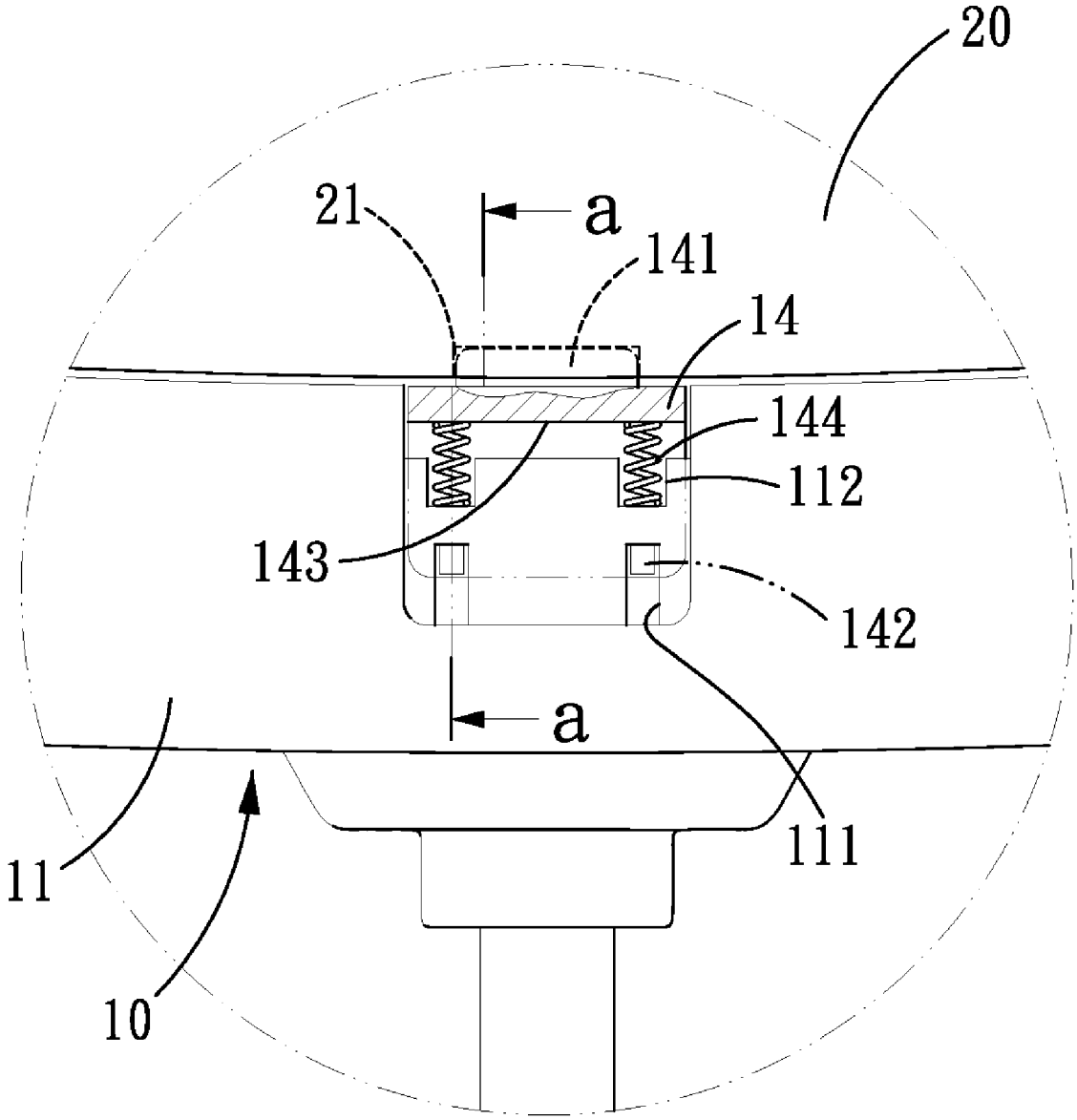
FIG. 9 is a cross-sectional view of the locking assembly in accordance with the present invention.
Figure 10:
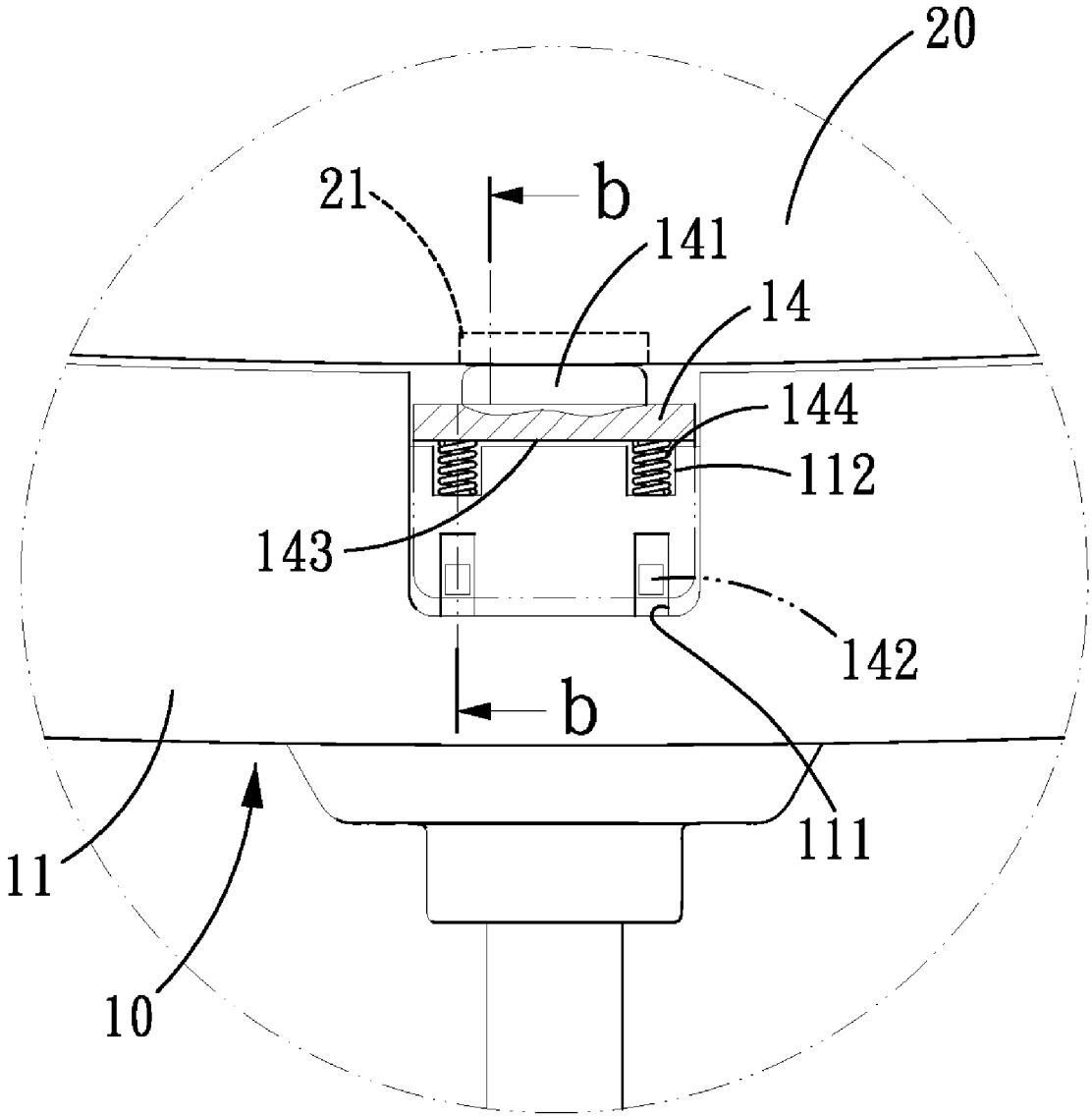
FIG. 10 is a partial cross-sectional view showing that the locking assembly in accordance with the present invention is compressed.
Figure 11:
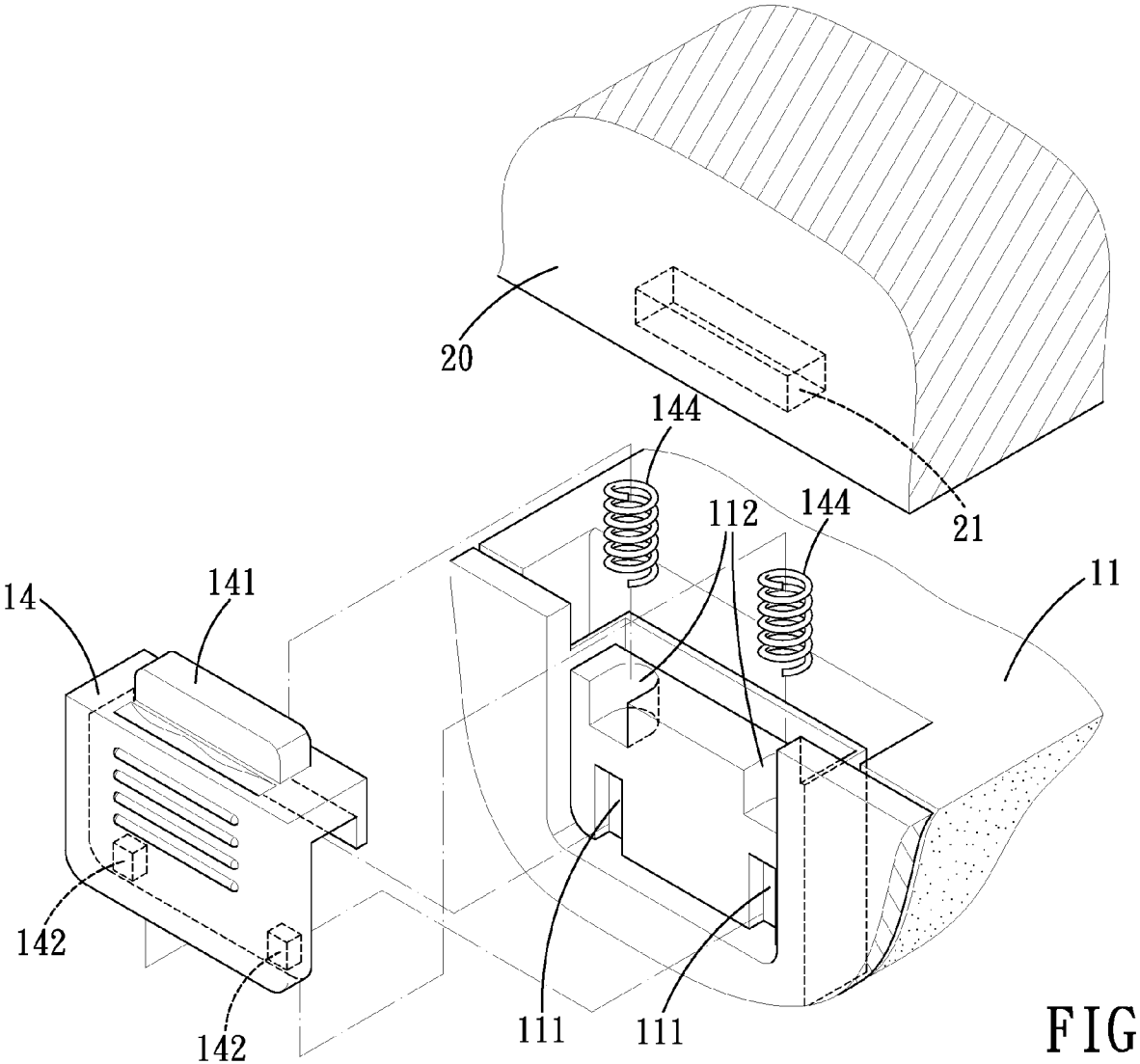
FIG. 11 is an exploded view of the locking assembly in accordance with the present invention and a part of the seat which is defined with two apertures and holes for cooperating with the locking assembly.
Figure 13:
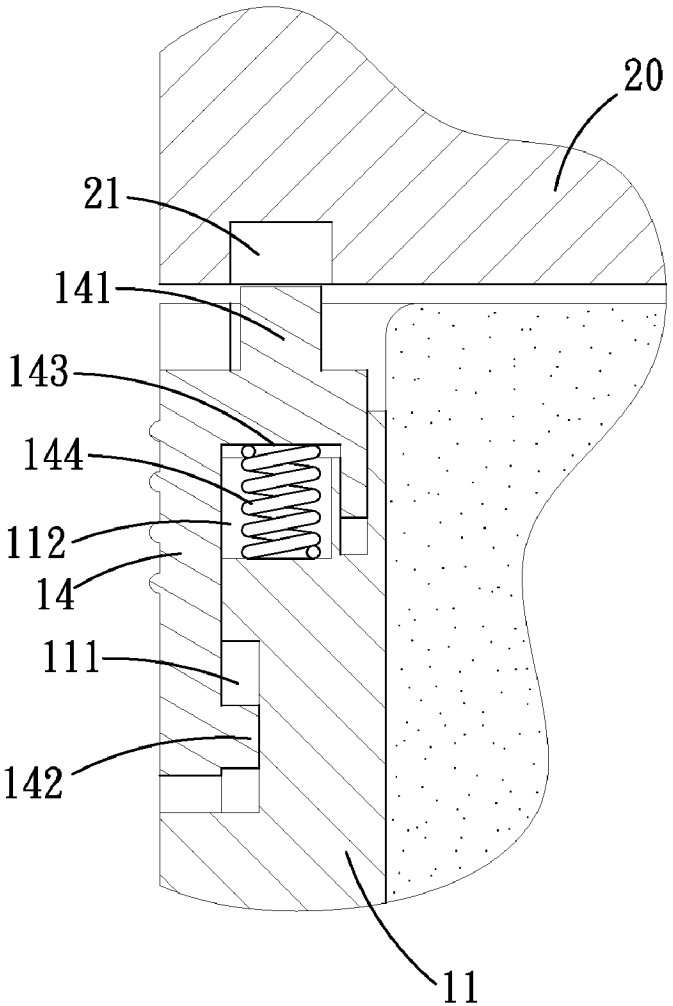
FIG. 13 is a cross sectional view taken along b-b of FIG. 10, which shows the compressed state of the locking assembly in the apertures.
Figure 12:
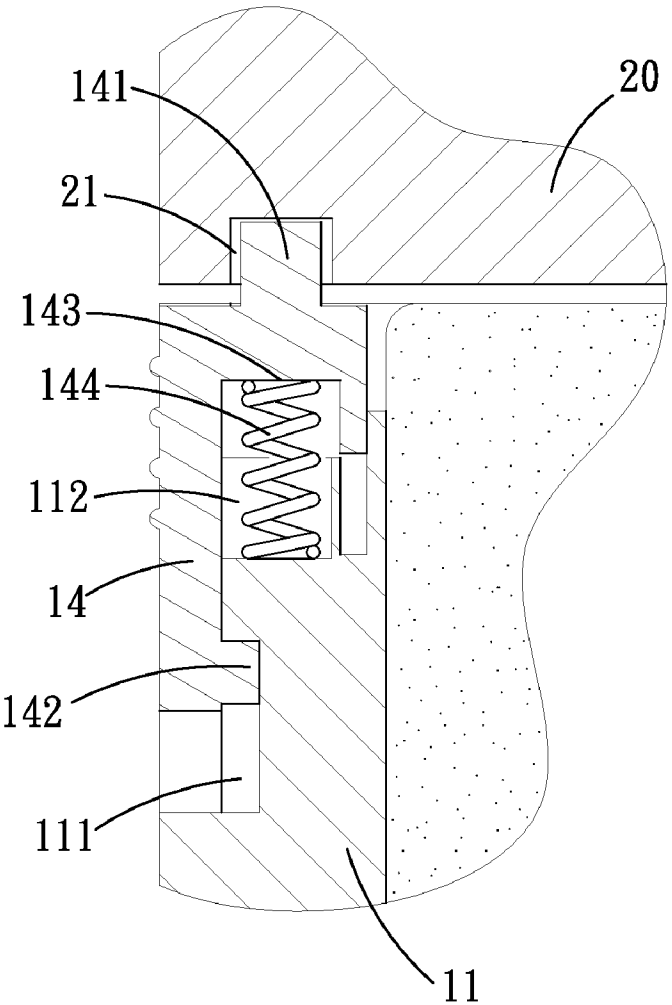
FIG. 12 is a cross sectional view taken along a-a of FIG. 9, which shows the non-compressed state of the locking assembly in the apertures.

When the chair back 20 is to be folded, as shown in FIGS. 6-8, the locking assembly 14 of the chair seat assembly 10 is operated to move the engaging protrusion 141 of the locking assembly 14 out of the engaging groove 21 of the chair back 20, so that the chair back 20 can disengage from the chair seat assembly 10, and then the chair back 20 will be pivoted relative to the chair seat assembly 10 in a folding manner. The elastically restorable structure of the locking assembly 14 is shown in FIGS. 9-13 in detail. The seat 11 of the chair seat assembly 10 includes two holes 111 and two apertures 112 which are located at the edge of the seat 11 corresponding to the locking assembly 14 in such a manner that the holes 111 are located at the lateral side of the edge while the apertures 112 are at the top side of the edge. The locking assembly 14 includes two restricting pillars 142, a stop surface 143 and two springs 144. The two restricting pillars 142 of the locking assembly 14 are accommodated in the two holes 111 of the seat 11, respectively. The springs 144 are received in the apertures 112 in such a manner that both ends of the respective springs 144 abut against the stop surface 143 and the respective apertures 112 of the seat 11 to make the locking assembly 14 move upwards and make the engaging protrusion 141 engage into the engaging groove 21 of the chair back 20. The two restricting pillars 142 restrict the locking assembly 14 in the seat 11. When the locking assembly 14, as shown in FIG. 10, is compressed downwards, the two springs 144 will be synchronously compressed by the stop surface 143 of the locking assembly 14 to make the engaging protrusion 141 move downwards to disengage from the engaging groove 21 of the chair back 20, so that the chair back 20 can be folded.

By such arrangements, not only the height of the armrests 30 of the chair can be adjusted, but the chair back 20 can be folded.

While we have shown and described various embodiments in accordance with the present invention, it is clear to those skilled in the art that further embodiments may be made without departing from the scope of the present invention.

What is claimed is:

1. A chair with height adjustable armrests and a foldable back comprising:

a chair seat assembly including a seat, two loading members and a locking assembly, the two loading members being disposed at both sides of the seat and each including an inserting groove, on an inner surface of which is formed plural spaced-apart protruding blocks, beneath the respective protruding blocks being defined an inserting space, the locking assembly being an elastically-restorable assembly disposed at a rear end of the seat and including an engaging protrusion;

a chair back having two sides each pivoted to the respective loading members through a pivot pin, the chair back being formed with an engaging groove for cooperating with the engaging protrusion of the locking assembly of the chair seat assembly, the engaging groove of the chair back being provided for insertion of the engaging protrusion, so as to lock the chair back to the chair seat in an operative position, the locking assembly being pushed to move the engaging protrusion out of the engaging groove, so as to allow the chair back to pivot relative to the chair seat assembly in a folding manner; and two armrests each including a support board, an inserting planar member and an elastically-restorable engaging rod, the support boards being connected with the respective inserting planar members, the engaging rods being L-shaped and pivoted to the respective support boards through a pivoting portion, the inserting planar member of the respective armrests being inserted in the inserting groove of the respective loading members of the chair seat assembly, the respective engaging rod having one end formed with an inserting block, the inserting block of the respective engaging rod being inserted into one of the inserting spaces in the inserting groove to position the armrest in the inserting groove, when a user presses the respective fastening rods, the fastening rods will be forced to pivot to make the inserting blocks disengage from the respective inserting spaces, so as to adjust a height of the armrests.

2. The chair with height adjustable armrests and a foldable back as claimed in claim 1, wherein the seat of the chair seat assembly includes two holes and two apertures, the locking assembly includes two restricting pillars, a stop surface and two springs, the two restricting pillars of the locking assembly are respectively accommodated in the two holes of the seat, both ends of the respective spring abut against the stop surface and the respective apertures to bias the locking assembly upwards and insert the engaging protrusion into the engaging groove of the chair back, so as to lock the chair back to the chair seat in an operative position.

3. The chair with height adjustable armrests and a foldable back as claimed in claim 1, wherein the pivoting portion is located between two ends of the engaging rod of the respective armrests for enabling the engaging rods to be pivoted to the respective support boards, each of the engaging rods includes the other end formed with a pressing block, the respective pressing blocks are provided with a spring, which abuts against the respective support boards to make the respective engaging rods pivot.

* * * * *